US011141341B2

(12) United States Patent
Koltzi et al.

(10) Patent No.: US 11,141,341 B2
(45) Date of Patent: Oct. 12, 2021

(54) SYSTEM AND METHOD FOR STROKE REHABILITATION USING POSITION FEEDBACK BASED EXOSKELETON CONTROL INTRODUCTION

(71) Applicants: Eleni Koltzi, Salonika (GR); Dimitrios Tzovaras, Salonika (GR); Ioannis Kostavelis, Salonika (GR); Paschalis Sideridis, Salonika (GR); Konstantinos Piliounis, Athens (GR)

(72) Inventors: Eleni Koltzi, Salonika (GR); Dimitrios Tzovaras, Salonika (GR); Ioannis Kostavelis, Salonika (GR); Paschalis Sideridis, Salonika (GR); Konstantinos Piliounis, Athens (GR)

( * ) Notice: Subject to any disclaimer, the term of this patent is extended or adjusted under 35 U.S.C. 154(b) by 387 days.

(21) Appl. No.: 16/404,183

(22) Filed: May 6, 2019

(65) Prior Publication Data

US 2019/0336381 A1 Nov. 7, 2019

Related U.S. Application Data

(60) Provisional application No. 62/667,470, filed on May 5, 2018.

(51) Int. Cl.

| | |
|---|---|
| ***A61H 1/02*** | (2006.01) |
| ***A63B 21/00*** | (2006.01) |
| ***A63B 22/00*** | (2006.01) |

(52) U.S. Cl.

CPC ..... *A61H 1/0288* (2013.01); *A61H 1/0266* (2013.01); *A63B 21/00178* (2013.01); (Continued)

(58) Field of Classification Search

CPC ..... A61H 1/0288; A61H 1/0266; A61H 2201/165; A61H 2230/00; A61H 2201/5064; A61H 2201/1409; A61H 2201/5007; A61H 2201/1638; A61H 2201/5069; A61H 2205/12; A61H 2205/067; A61H 2201/1207; A61H 1/0285; A63B 21/00178; A63B 21/00181; A63B 22/00; A63B 2022/0094

See application file for complete search history.

(56) References Cited

U.S. PATENT DOCUMENTS 4,724,827 A * 2/1988 Schenck ..... A61H 1/0288 601/40
5,667,461 A * 9/1997 Hall ..... A61H 1/0229 472/15

(Continued)

*Primary Examiner* — Garrett K Atkinson

(57) ABSTRACT

An improved dual glove exoskeleton system and method for rehabilitation of stroke victims is provided to increase recovery through optic, neural, and muscular stimulation. The proposed approach employs an algorithm that is configured to determine a degree of dysfunction, of certain extremities, and in particular, an upper extremity. During rehabilitation and recovery, the proposed system is designed to monitor a position of a healthy limb and allow a patient to attempt a mirrored position in a damaged limb. The system and method then completes the movement in an assisted-control manner. The system detects how each finger responds individually to the treatment and chooses an exercise program that is appropriate under the circumstances to further assist with rehabilitation.

10 Claims, 9 Drawing Sheets

(52) U.S. Cl.
CPC ..... *A63B 21/00181* (2013.01); *A63B 22/00* (2013.01); *A61H 2201/1409* (2013.01); *A61H 2201/165* (2013.01); *A61H 2201/1638* (2013.01); *A61H 2201/5007* (2013.01); *A61H 2201/5064* (2013.01); *A61H 2230/00* (2013.01); *A63B 2022/0094* (2013.01)

(56) References Cited

U.S. PATENT DOCUMENTS 6,123,649 A * 9/2000 Lee ..... A63B 21/153 482/51
6,666,831 B1 * 12/2003 Edgerton ..... A61H 1/0237 600/587
6,796,926 B2 * 9/2004 Reinkensmeyer ... A61B 5/1038 482/51
7,331,906 B2 * 2/2008 He ..... A61H 1/0237 482/69
7,494,450 B2 * 2/2009 Solomon ..... A61H 1/0229 482/51
7,887,471 B2 * 2/2011 McSorley ..... A63B 23/0355 482/138
7,935,036 B2 * 5/2011 Haynes ..... A63B 21/4025 482/124
7,998,040 B2 * 8/2011 Kram ..... A63B 21/4013 482/124
8,057,410 B2 * 11/2011 Angold ..... A61H 3/008 601/5
8,608,479 B2 * 12/2013 Liu ..... A61H 3/008 434/255
9,266,233 B2 * 2/2016 Kornbluh ..... F16D 28/00
2003/0064869 A1 * 4/2003 Reinkensmeyer ..... A61H 3/008 482/100
2004/0087418 A1 * 5/2004 Eldridge ..... A63B 21/157 482/54
2004/0204294 A2 * 10/2004 Wilkinson ..... A63B 23/03525 482/54
2005/0101448 A1 * 5/2005 He ..... A63B 22/02 482/54
2008/0300118 A1 * 12/2008 Wehrell ..... A63B 23/047 482/129
2010/0204804 A1 * 8/2010 Garrec ..... B25J 9/0006 623/24
2011/0313331 A1 * 12/2011 Dehez ..... A61H 1/0277 601/33
2012/0041513 A1 * 2/2012 Tucker ..... A61N 1/36034 607/48
2012/0058861 A1 * 3/2012 Satut ..... H01H 3/141 482/8
2013/0130866 A1 * 5/2013 Wehrell ..... A63B 21/00065 482/5
2013/0225371 A1 * 8/2013 Harrer ..... A63B 21/16 482/8
2014/0172166 A1 * 6/2014 Kim ..... B25J 9/1697 700/259
2014/0277739 A1 * 9/2014 Kornbluh ..... A41D 1/005 700/260
2015/0173993 A1 * 6/2015 Walsh ..... B25J 9/0006 414/4
2015/0297934 A1 * 10/2015 Agrawal ..... A61H 1/0266 482/4
2019/0209086 A1 * 7/2019 Huang ..... A61B 5/1125

* cited by examiner

*Advantages - Differentiation*

| Characteristics | RETOucH Exoskeleton | Rehab-Robotics (Hand of Hope) | Tyromotion (Amadeo) | Biometrics LTD σύστημα |
|---|---|---|---|---|
| Start immediately after the stroke | ✓ | | | |
| Passive mobilization | ✓ | ✓ | | ✓ |
| Assisted mobilization | ✓ | | | |
| Visualization of orders from the brain | ✓ | | | |
| Finger excercises combined | ✓ | | ✓ | |
| No restrictions | ✓ | | ✓ | |

FIG. 5

SYSTEM AND METHOD FOR STROKE REHABILITATION USING POSITION FEEDBACK BASED EXOSKELETON CONTROL INTRODUCTION

BACKGROUND OF THE INVENTION

The present invention is directed to a system and method for rehabilitation of damaged limbs in stroke victims.

There are currently around 613,000 strokes in Europe per year, of which over 60% result in upper limb dysfunction. In addition, it is estimated that the total amount of European stroke-related healthcare expenditure is EUR 45 billion per year, which is expected to average 35% by 2020. In this amount, more than 50% is classified as post-intervention and rehabilitation costs. There is therefore an urgent need for technological solutions to be implemented in this area.

The present invention aims to help people suffering from a stroke and having a malfunction at the upper extremity. As the population with stroke increases in all European countries, innovative care methods must be launched. The patients with upper limb dysfunction are the users of the product.

According to the latest Health Ministry data, EAFRD spends an annual cost of 145,200,000 euros for stroke recovery. According to the above data, the application of innovative physiotherapeutic approaches with robotic devices will reduce the annual cost of spending in Greece by 50%, reducing the rehabilitation time for each patient by half. The ultimate goal of the new physiotherapy device is to minimize recovery time and the total cost of the rehabilitation program.

Regarding current techniques, mirror therapy is a rehabilitation method currently used with a patient after stroke for rehabilitation of an upper limb. Mirror therapy is a type of motor imagery whereby the patient moves his unaffected limb while watching the movement in a mirror. This in turn sends a visual stimulus to the brain to promote movement in the affected limb. However, this method is partially ineffective due to the fact that only visual stimulus is applied to the brain, since the damaged limb does not physically participate in the therapy.

Conventional robotic systems focus on adjusting the degree of difficulty (force feedback) and not on detecting finger response (position feedback), for example, and causing targeted exercises aimed at completing the range of motion needed for the patient to complete hand exercises. By precisely targeting the degree of movement, and basing correction of dysfunction on the degree or range of dysfunction, there can be continuous feedback and immediate dynamic adjustment during an exercise.

SUMMARY OF THE INVENTION

The present invention includes a movement monitoring device (control glove) mounted on the unaffected, or healthy, limb which copies movement of the healthy limb to an actuation device (exoskeleton glove) mounted on the affected, or damaged, limb in order to replicate the movement of the healthy limb in the damaged limb. The actuation device can be applied directly on the damaged limb right after the incident in order to provide motion, which significantly contributes to the faster rehabilitation of the damaged regions of the brain. Optic, kinetic, and aesthetic neurons are activated simultaneously, which are directly related to the transmission of the stimuli/commands from the central to peripheral nervous system.

A novel algorithm is configured to determine a degree of dysfunction, of certain extremities, and in particular, an upper extremity. During rehabilitation/recovery, the proposed system is designed to complete the movement in an assisted control manner. The system detects how each finger responds individually to the treatment and chooses an exercise program that is appropriate under the circumstances.

A preferred embodiment of a dual glove system for rehabilitating a damaged hand after a stroke, comprises:

an exoskeleton glove having an exoskeleton configured to extend at least along the length of each digit of a damaged hand, at least one actuator mechanically connected to the exoskeleton and capable of at least flexing a portion of the exoskeleton extending along the length of each digit, a plurality of sensors, wherein a sensor of the plurality of sensors extends along the length of each digit of the exoskeleton glove and corresponding to each digit of the damaged hand, and an exoskeleton glove control system electronically connected to the at least one actuator and the plurality of sensors;

a control glove having a plurality of sensors, wherein a sensor of the plurality of sensors extends along the length of each digit of the control glove and corresponding to each digit of healthy hand, and a control glove control system electronically connected to the at least one actuator and the plurality of sensors;

wherein the plurality of sensors on the control glove collect and transmit data regarding position of each digit on the healthy hand via the control glove control system to the exoskeleton glove control system, and the exoskeleton glove control system instructs the at least on actuator to move the exoskeleton causing the damaged hand to mirror the position of the healthy hand regardless of a position of each digit of the damaged hand upon the exoskeleton glove control system receiving the data gathered by the plurality of sensors on the control glove.

A preferred embodiment of a method for rehabilitation using position feedback of an impaired extremity to complete the positional movement associated with an exercise using an exoskeleton robotic arm employing both active and passive motion, the method comprises:

determining a position of a healthy extremity;

determining a position of the impaired extremity;

directing a patient to attempt to mirror the position of the impaired extremity with the position of the healthy extremity;

calculating the amount of relative positional motion of one or more locations on the impaired extremity needed to cause the exoskeleton robotic arm to complete the positional movement necessary to mirror the position of the impaired extremity with the position of the healthy extremity, but only after waiting a period of time sufficient to allow a patient to passively partially complete the exercise on their own; and causing the exoskeleton to provide active assisted motion to help the patient to complete the positional movement.

Another method of the invention comprises:

(i) Patient using a data glove employed on a healthy extremity (e.g., a hand) to record the motion of one or more digits associated with a desired exercise. Appropriate finger measuring sensors and corresponding finger position measurement techniques are employed using a controller equipped with microcontrollers, memory and other logic circuity configured to process data from the good glove. Such techniques are well known in the art.

(ii) Patient emulating the exercise using the damaged (hemiplegic) hand, where the damaged hand is fitted with an exoskeleton glove configured to provide assisted motion in accordance with the exemplary embodiments of the present invention. Sensors fitted on the damaged hand below the exoskeleton provide real time feedback to the aforementioned controller which allows the controller to identify how successful the patient was in reproducing the motion of the healthy hand.

(iii) In accordance with a preferred embodiment, the controller waits a predefined period (ex. five seconds) before completing exoskeleton feedback measurements. Having done that, the controller calculates the amount of assisted motion that is to be applied to one or more digits, on a digit-by-digit basis. The calculations correspond to precise exoskeleton-assisted motion to cause the patient to complete the exercise performed on the healthy hand.

The controller relies on the two gloves to compare sensor values. The exoskeleton glove and corresponding motion detection sensors identify the angle of each finger and are thus able to understand how much help a patient needs to complete a movement made in the good hand.

In addition to the assisted action, it is contemplated that a patient may optionally select complete passive mobilization (P/M). In P/M mode (or passive mode), the exercise made with the good hand is emulated in full by the controller. The exoskeleton glove merely reproduces the complete exercise motion, and usually without waiting for the patient. In this mode, usually the patient's brain is completely unable to send any instruction to nerves in the impaired hand.

In a further related embodiment, instead of a data glove, the suggestion for exercises to be reproduced by the patient are provided using a virtual reality (VR) or augmented reality (AR) environment. Such solutions are well known in the art. Needless to say, the prior art does not address the problem of assisted motion but only after waiting for the patient to first act. While force feedback techniques have been known using robotic arms, exoskeleton gloves and the like, the presently proposed approach focuses on precise assisted position adjustment and specifically position adjustment for patients with at least some motor movement in hemiplegic extremity.

BRIEF DESCRIPTION OF THE SEVERAL VIEWS OF THE DRAWINGS

Reference to the following drawings will improve the understanding of the present invention and its embodiments:

FIG. 5 is a table showing different capabilities between the proposed (RETOucH) exoskeleton system of the present invention and conventional robotic arms;

DETAILED DESCRIPTION OF THE INVENTION

The present invention solves the problem of limited stimuli (i.e. only visual stimulus) being used in mirror therapy techniques to help patients recover limb movement due to stroke by providing a dual glove system which monitors the current angle of each finger and thumb of a damaged limb and applies only the required, or remaining, effort needed to complete motion of the damaged limb to mirror motion in a healthy limb. To achieve this, a comparison, or subtraction, between a current and a desired position for the angles of the damaged limb is applied, given the monitored motion from the healthy limb, in order to apply the required effort supplied by an actuation system attached to an exoskeleton glove on the damaged limb. There is a time interval between application of the recorded motion from the healthy limb to the damaged limb. A patient is prompted to perform an identical action in both the healthy limb and the damaged limb during the time interval. Thus, the respective neurons are triggered and the after the expiration of this time interval, the rest of the unapplied motion, if necessary, is performed on the damaged limb through the actuation system. With this procedure the user participates actively in the rehabilitation therapy since it forces the brain to apply the motion and the outcome is accompanied with kinetic and optic stimulus.

Figure 1:
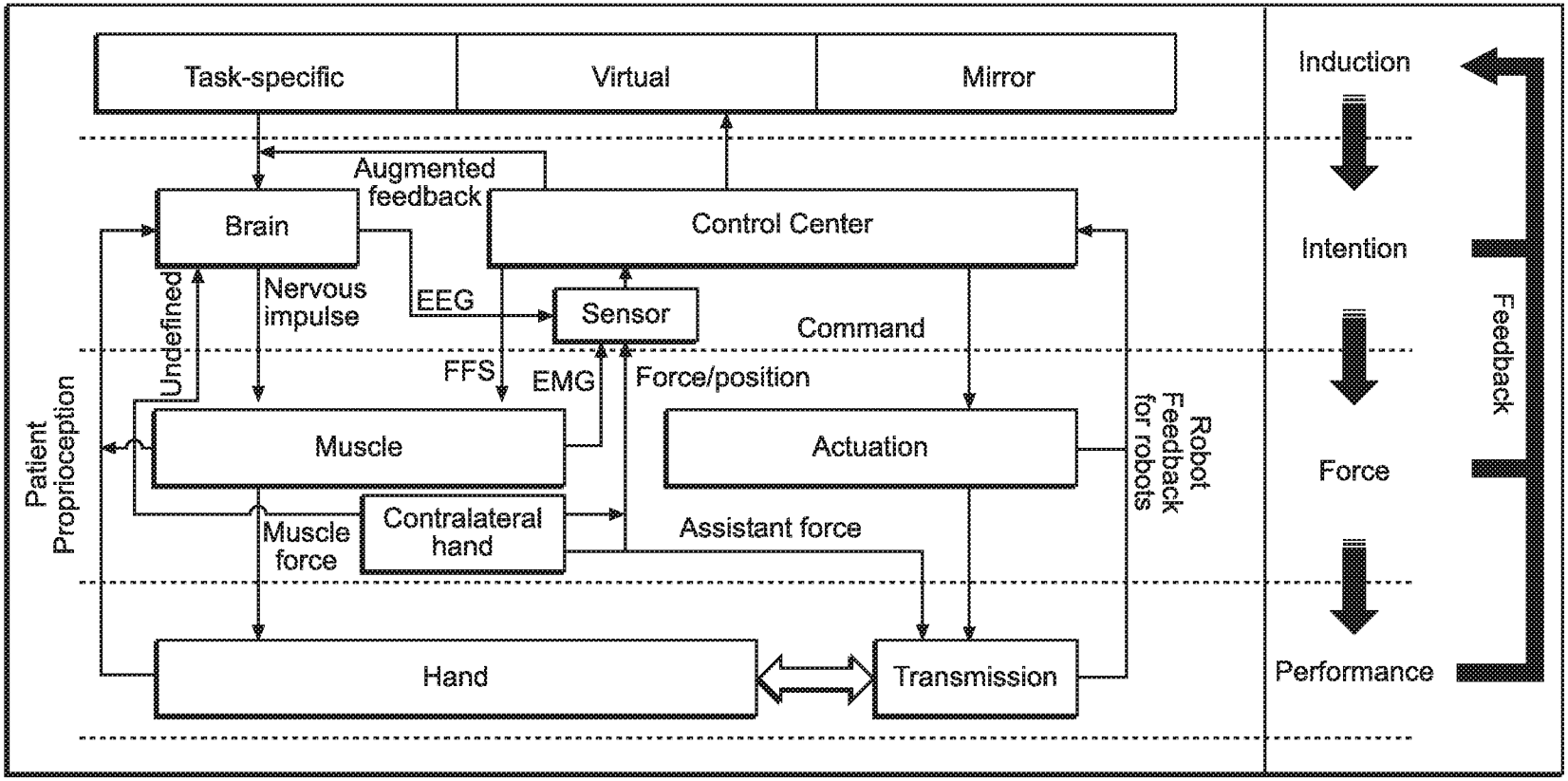
FIG. 1 is a diagram in accordance with a preferred method of the present invention.

FIG. 1 shows a diagram providing a chart of various feedback activities that play a function in the operation of a fully functioning system and method of the present invention as contemplated herein. The diagram applies to both the dual glove embodiment, as well as to VR/AR environments. The diagram also captures both passive and active modes of operation as well as optional force-feedback operation in addition to position movement operation. As to position movement operation, this covers both the assisted technique contemplated by the present invention, as well as other assisted position movement techniques which operate differently from the presently proposed approach.

The diagram of FIG. 1 is broadly broken down into four stages of the recovery process: induction, intention, force, and performance. Induction involves bringing about recovery to a damaged limb by artificial means, specifically through the dual glove embodiment. Intention involves stimulating the brain through visual cues, wherein the present invention provides augmented feedback through sensor data collection and transmission to a control center. Force involves muscle stimulation in response to brain stimulation to re-establish peripheral neural connections, wherein the patient attempts to mirror movements in opposite limbs. Performance involves completing mirrored movement in damaged limb as seen in the healthy limb via assistant force provided by exoskeleton in glove or system on the damaged limb. Feedback is provided at each of the four levels to improve and/or change assistance of the dual glove system in response to changing circumstances of data received from healthy and damaged limbs.

Figure 2:
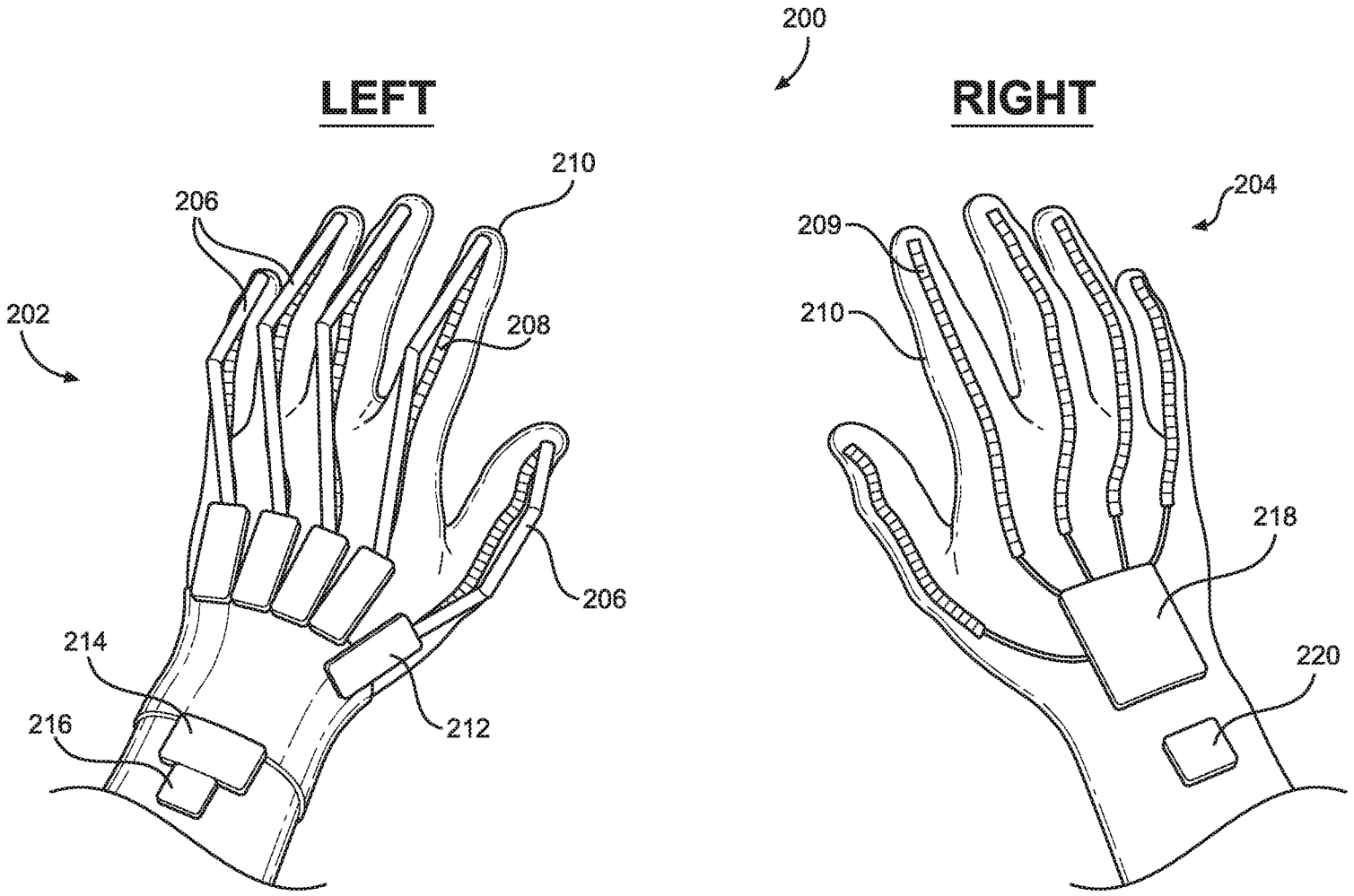
FIG. 2 is a representation of a two glove system and associated logic circuitry according to the present invention.

FIG. 2 shows a preferred embodiment of a dual glove system 200. In this embodiment of the system 200, an exoskeleton glove 202 is positioned on a left hand, which is a damaged hand in this case, and a control glove 204 is positioned on a right hand, a healthy hand in this case. An alternative embodiment contemplated has the exoskeleton glove on the right hand and the control glove on the left hand, the damaged hand being the right hand and the healthy hand being the left hand. The exoskeleton glove 202 and control glove 204 each have a plurality of sensors 208 and 209, respectively, with a sensor of each plurality positioned along the length of each finger and thumb of each glove. Each sensor of each plurality 208, 209 extends from about the tip or fingernail of each finger or thumb, along the top length of each finger and thumb, to the back of the hand. It is also possible for the plurality of sensors to extend along the palm-side of each hand, but this is not preferable as grasping objects may interfere with the sensor readings. The exoskeleton glove 202 has one or more actuators 212 attached to the surface of the glove, secured within the glove, or otherwise integrated with the glove. In this embodiment, an actuator 212 is provided for each digit of the left hand. Each actuator 212 is operably connected to an exoskeleton 206 extending along the length of each finger and thumb of the exoskeleton glove 202. The exoskeleton 206 is structured and positioned to be able to apply appropriate force to the hand, or other limb, to complete a full range of motions. The resulting structure of the exoskeleton may therefore vary greatly. In the preferred embodiment, the exoskeleton is a series of two or more rigid structures hingedly connected in series at longitudinal ends, such that the exoskeleton extends along the length of each digit. The exoskeleton glove 202 also has a microcontroller 214 for sensors and actuators attached to the outer surface of the glove, secured within the glove, or otherwise integrated with the glove for electronically and/or wirelessly controlling the actuators 212 and exoskeleton 206. Further, a connection microcontroller 216 is attached to the outer surface of the glove, secured within the glove, or otherwise integrated with the glove, and is in electronic communication with the sensor and actuator microcontroller 214 and a connection microcontroller 220 on the control glove.

The connection microcontroller 220 is attached along an outer surface of the control glove 204, secured within the glove, or otherwise integrated with the glove, and is electronically and/or wirelessly connected to a sensor microcontroller 218 also attached along an outer surface of the glove 204, secured within the glove, or otherwise integrated with the glove. The sensor microcontroller is electronically and/or wirelessly connected to each sensor of the plurality of sensors 209 positioned along the control glove. Glove material 210 for both the exoskeleton glove 202 and the control glove 204 secures the gloves 202, 204 about the hands and/or limbs of a patient and provides attachment points, surfaces, and/or layers in which the discussed elements of each glove 202, 204 may be attached to, secured to, or housed. Further, the glove material 210 is a flexible material made from known flexible materials for gloves, such as plastics, composites, woven fibers, etc., or any material that can or will be used to form gloves. The actuators 212 can be pneumatic, hydraulic, motorized, or operate by a similar mechanism.

While the logic circuitry and controllers 214, 216, 218, and 220 are shown integrated fully or partially on one or the other glove, a separate stand-alone controller is also contemplated. An appropriate UI or similar monitor interface is also contemplated.

The preferred embodiment of the system 200 may be applied to the left and right foot, and vice versa, in an alternative embodiment of the system, wherein a sensor extends along each digit of a foot. In such an embodiment, each glove would alternatively be referred to as a sock, but would otherwise fulfill the same function on the feet instead of the hands.

In use, the control glove 204 captures movement and position data of the healthy limb via the plurality of sensors 209. The data is sent to the sensor microcontroller 218 and a connection microcontroller, each with the necessary processors to collect and transmit the data. The connection microcontroller 220 on the control glove 204 then transmits the data to at least the connection microcontroller 216 on the exoskeleton glove 202. The data may also be sent to a remote computer or display. The data is sent to the actuator microcontroller 214. The plurality of sensors 208 on the exoskeleton glove measures position of the damaged hand. After a time interval, if the damaged hand is not in the same position as the healthy hand based on the data transmitted and received, the actuator microcontroller 214 commands the at least one actuator to move the exoskeleton to provide enough force to the damaged hand to complete the mirrored position. Once the mirrored mission is completed, the actuators allow the exoskeleton to relax and stop applied force until the next mirrored movement is performed.

Figure 3:
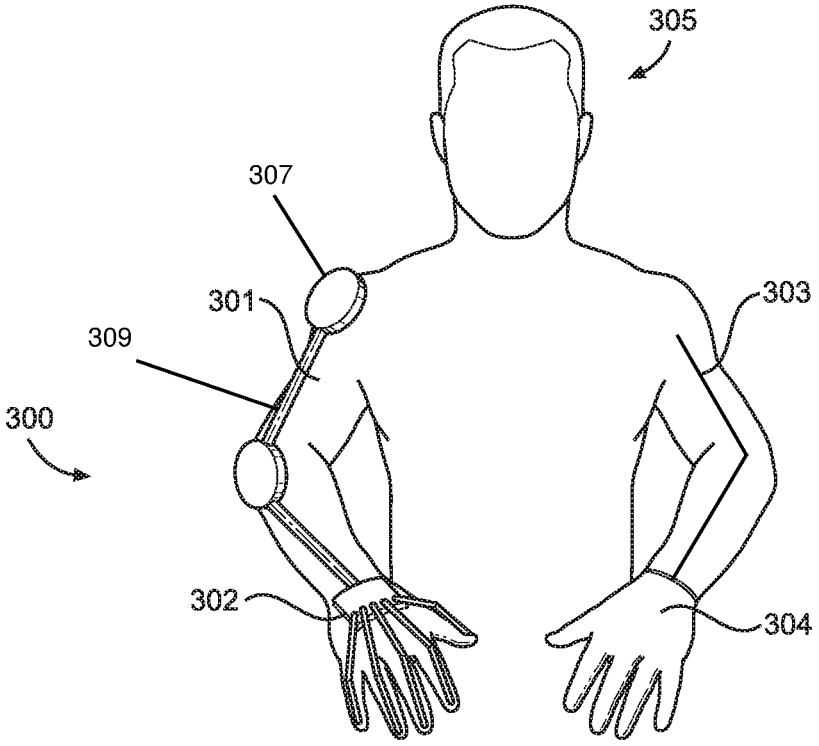
FIG. 3 is a representation of a full arm exoskeleton and data glove combination including the two glove system of FIG. 2.

FIG. 3 shows an alternative embodiment of the dual glove system 300, wherein an exoskeleton glove 302, which otherwise includes all of the elements and structure of the glove 202 of the preferred embodiment 200, further includes actuators 307 and exoskeleton 309 further extending along a lower arm and an upper arm of a damaged limb 301 of a patient 305, such that the system 300 may help rehabilitate an entire arm from shoulder to fingertip. A control glove 304 that otherwise has similar structure to the control glove 202 of the preferred embodiment 200, further has one or more sensors 303 extending along an upper and lower arm of the patient. These additional sensors 303 collect and transmit data similar to sensors along each digit so that the exoskeleton and actuators along the opposite upper and lower arm of the patient can assist in mirroring movement in the damage limbs. Further, this embodiment may be replicated on a foot, lower leg, and upper leg, wherein a sensor extends along each digit of a foot. In such an embodiment, each glove would alternatively be referred to as a sock, but would otherwise fulfill the same function on a different limb.

Figure 4:
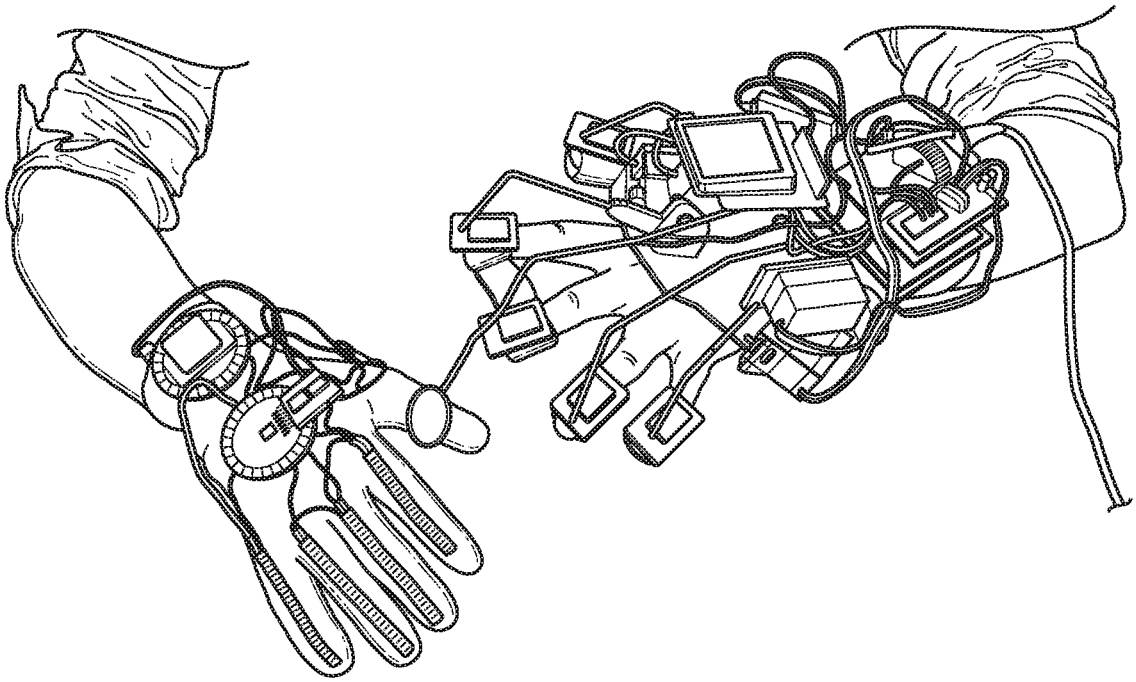
FIG. 4 is a representation of an alternate embodiment of the dual glove system.

FIG. 4 shows an alternative embodiment of the dual glove system, wherein flex sensors are not included with the exoskeleton glove.

Regarding further structure of the dual glove system, the control glove is mounted on the healthy limb and includes sensors which record the angle of each finger and thumb as data when performing a single motion. The data is stored either locally at the control glove, or electronically communicated to and stored in an external device or to a cloud and transmitted through a communication link, such as wireless, Bluetooth, or protocol agnostic manner, to an actuation mechanism, or exoskeleton, on the exoskeleton glove which is mounted on the damaged limb. The actuation mechanism can be pneumatic, hydraulic, motorized, or a similar mechanism. The exoskeleton glove also has the sensors that measure the angle of each finger and thumb. The data is transmitted to the actuation device and is compared to the current angle values of each finger and thumb in the damaged limb. If there is a difference between the current angle of each finger and thumb in the control glove and the angle of each corresponding finger and thumb in the exoskeleton glove, the actuation system undertakes moving each finger and thumb of the damaged limb towards the correct position, as necessary, to complete the unperformed action or the rest of the action which might have been partially completed to mirror the position of each finger and thumb of the damaged limb with the position of each finger and thumb of the healthy limb. Therefore, the actuation system of the exoskeleton glove uses position feedback in order to achieve the same end position of each finger and thumb when compared with the healthy limb.

The dual glove system supports further functionalities for improving recovery of motor functions in stroke patients. The actuation system of the dual glove system can simply copy and apply the recorded motion from the healthy limb to the damaged limb. Further, the actuation system can provide required motion progressively based on a comparison between the desired set of angles required for the motion and current angle values of each finger and thumb of the damaged limb. The dual glove system can also record the applied actuated motion and quantify the participation of the patient in the motion. The dual glove system can further be applied to left and right upper limbs and/or left and right lower limbs.

FIG. 5 provides a table comparing four different stroke-recovery systems based upon six features. The present invention, characterized as "RETOucH Exoskeleton" in the table, includes all six features, including the ability to start treatment immediately after a stroke, passive mobilization, assisted mobilization, visualization of orders from the brain, finger exercises combined, and no restrictions. None of the other three devices (Hand of Hope, Amadeo, or Biometrics LTD) provide all six features.

Figure 6:
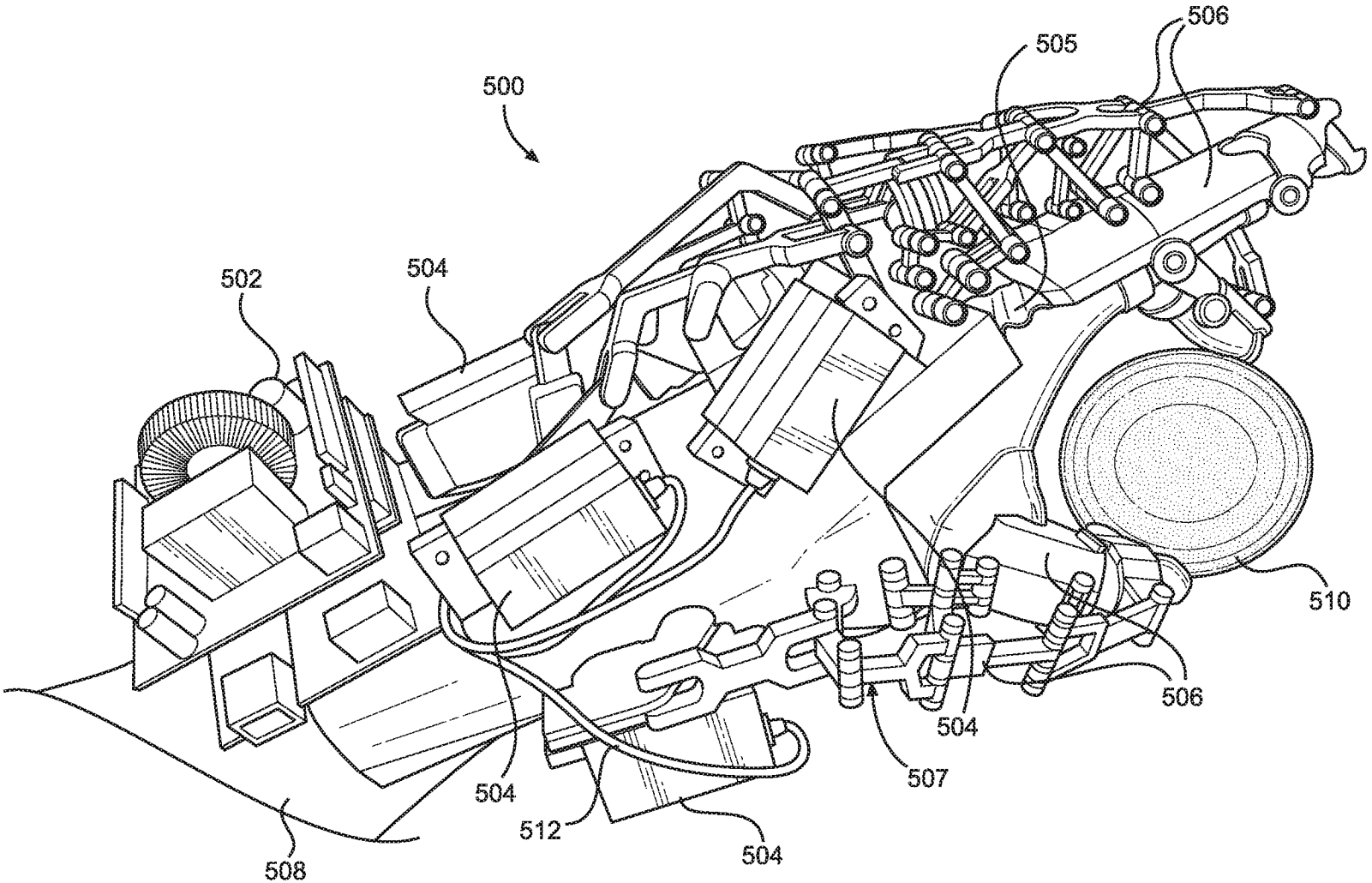
FIG. 6 is an embodiment of the exoskeleton glove on a human hand.

FIG. 6 depicts an embodiment of an exoskeleton glove 500 grasping an object 510, where the exoskeleton glove is paired with a control glove embodiment described herein. The exoskeleton glove 500 includes an exoskeleton 506 extending at least along each finger and thumb of a damaged limb 508. The exoskeleton is mechanically connected to one or more actuators 504. In this embodiment 500, an actuator 504 is provided for and connected to the exoskeleton of each digit. Each actuator 504 is electrically connected to the other actuators by one or more cables 512. It is contemplated that a cable may not be necessary and that the one or more actuators may be powered and in communication with other actuators and microprocessor wirelessly, for example, wherein the one or more actuators are powered by a dedicated battery and utilize wireless electronic communication. The one or more actuators are further in electronic communication with a control system 502. Together, the exoskeleton, one or more actuators, and one or more cables comprise an actuation system, controlled by and in electronic communication with the control system 502. The control system 502 includes a microcontroller and voltage regulators. The control system 502 regulates a pneumatic system, which comprises air pressure sensors for regulation of air pressure within each of the one or more actuators 504, miniature solenoid valves, and a miniature diaphragm pneumatic pump. The microcontroller regulates the measured air pressure to track the desired air pressure and uses pulse width modulation to control the activation and deactivation of valves, which in turn controls each actuator 504 and ultimately the movement of the exoskeleton 506 along each digit of the damaged hand 508. The exoskeleton glove 500 also includes sensors 505 extending along each digit of the damaged limb to collect and transmit data of positions of each digit to the control system 502.

Figure 7:
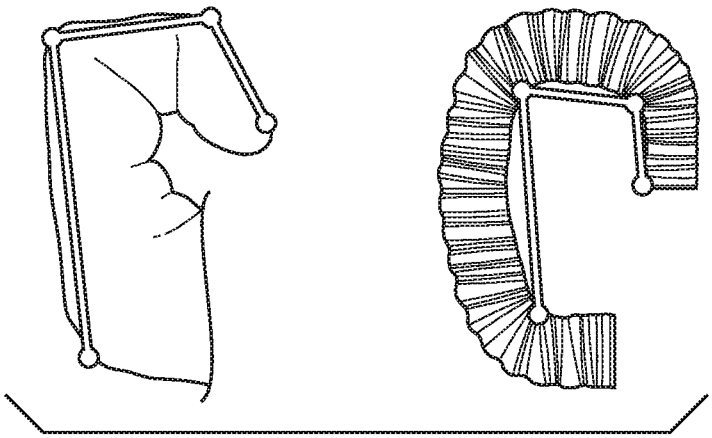
FIG. 7 is a comparison between the flexion of a human finger and flex sensors and soft actuators of an alternative embodiment of the present invention.
Figure 8:
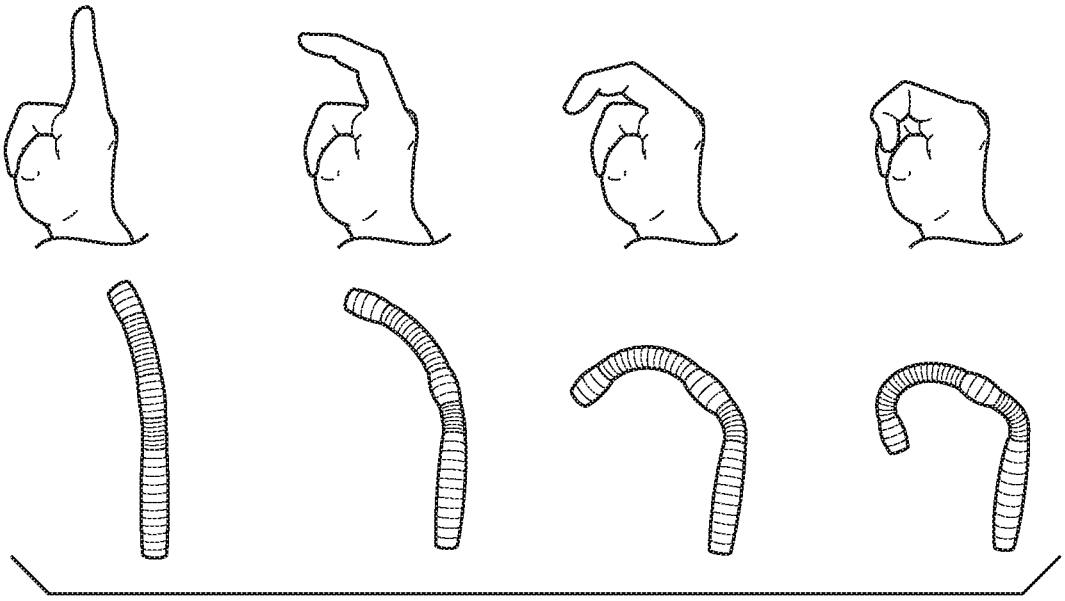
FIG. 8 is a further comparison between the flexion of multiple human fingers and corresponding flex sensors and soft actuators of the alternative embodiment of FIG. 7.

FIGS. 7 and 8 depict an embodiment of sensors incorporated in embodiments of the dual glove system described herein, along with representative movements of a corresponding finger (e.g. pointer finger). The sensors are flexible sensors, also referred to as flex sensors. FIG. 7 depicts a curled pointer finger with four points mapped along an upper surface of the finger, along with a corresponding flex sensor curled to match the four corresponding points such as if the flex sensor were positioned on the upper surface of the finger. FIG. 8 likewise shows four more unique positions of a pointer finger, with a corresponding flex sensor below each representation and positioned relative to each finger to match each position. Each flex sensor collects data based upon its position based upon points as seen in FIG. 7 and communicates the data to the exoskeleton glove via the necessary electronic communication structures. The exoskeleton glove then assists the damaged limb in achieving the same position of each finger and thumb of the healthy limb based upon the data collected by each flex sensor.

Figure 9:
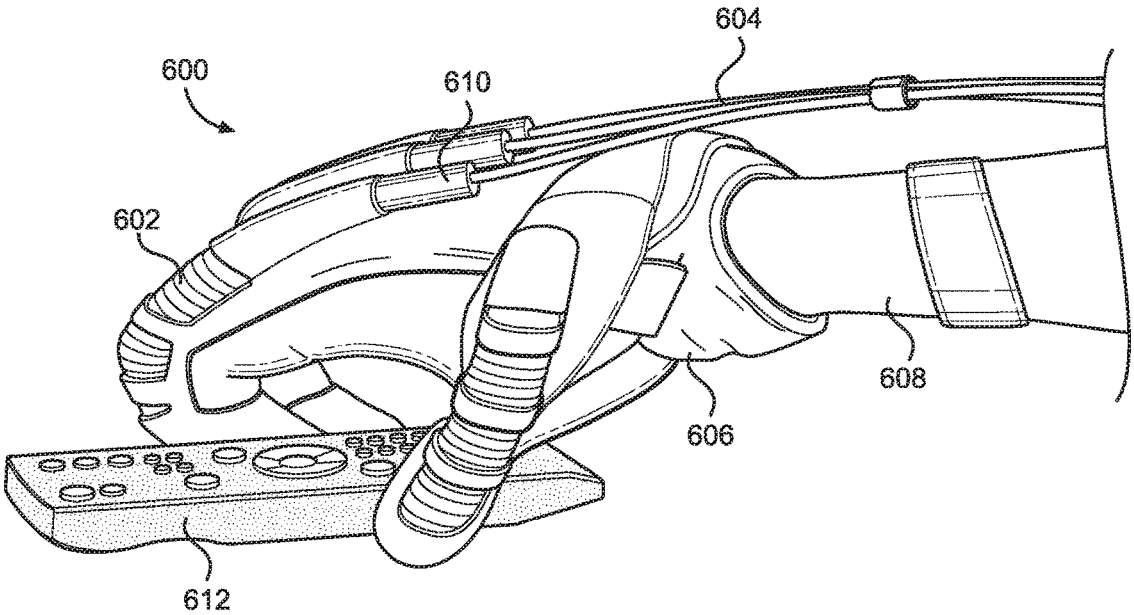
FIG. 9 is a representation of an exoskeleton glove having flex sensors and soft actuators of the alternative embodiment of FIG. 7.
Figure 10:
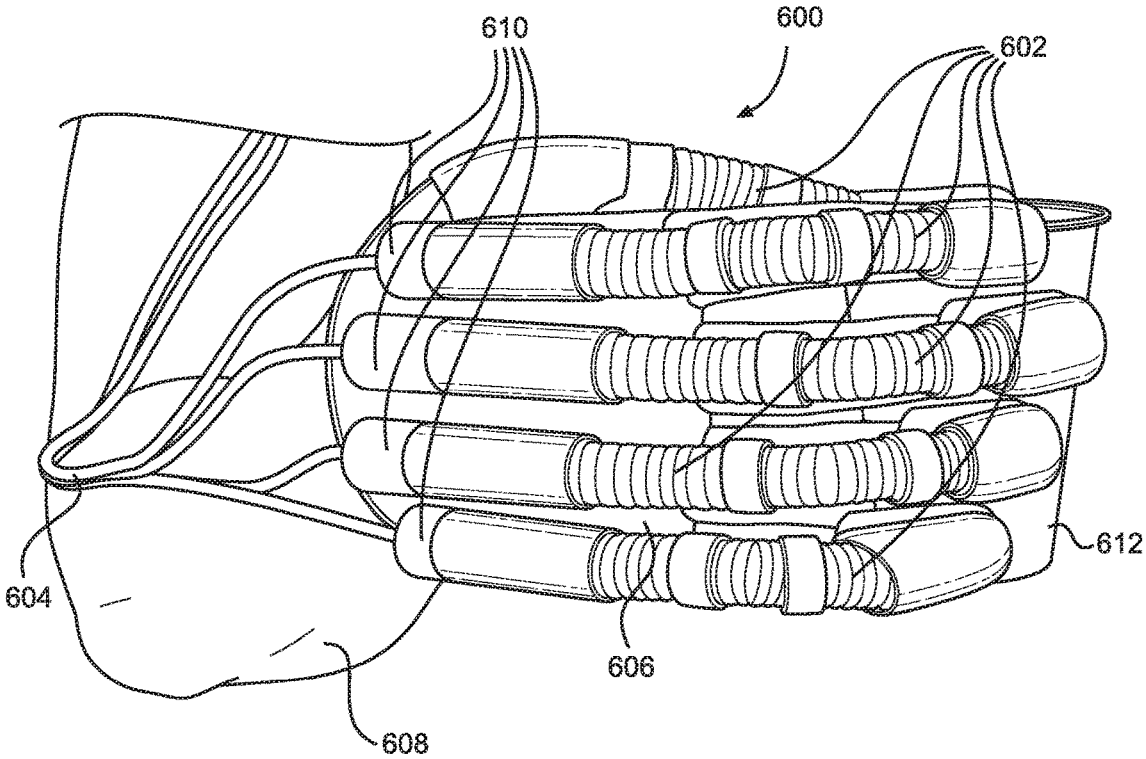
FIG. 10 is another view of the exoskeleton glove of FIG. 9 having flex sensors and soft actuators of the alternative embodiment of FIG. 7.
Figure 11:
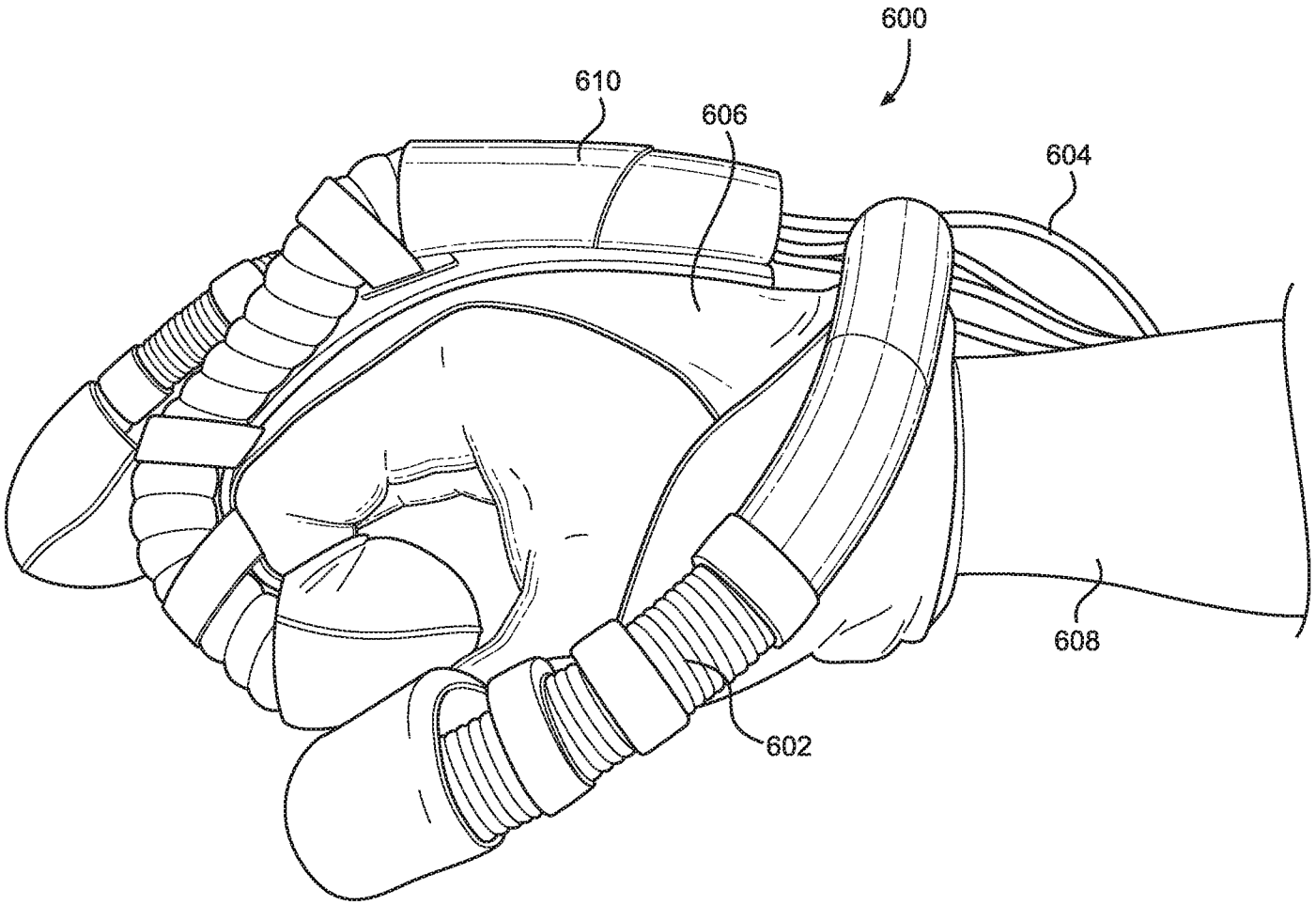
FIG. 11 is another view of the exoskeleton glove of FIG. 9 having flex sensors and soft actuators of the alternative embodiment of FIG. 7.

FIGS. 9-11 depicts multiple views an alternative embodiment of an exoskeleton glove 600, wherein the exoskeleton and sensors for each digit are incorporated into a flex sensor 602 of a plurality of flex sensors, each flex sensor having an actuator 610 connected to a control system via a cable 604 as described in other embodiment of the exoskeleton glove. Each flex sensor 602 is movable via the corresponding actuator 610 and secured to a glove 606 or substantially similar structure placed about a damaged limb 608 such that a flex sensor extends along each digit of the damaged limb. The specific type of actuator 610 used may vary according to other discussed embodiment of the invention.

Figure 12A:
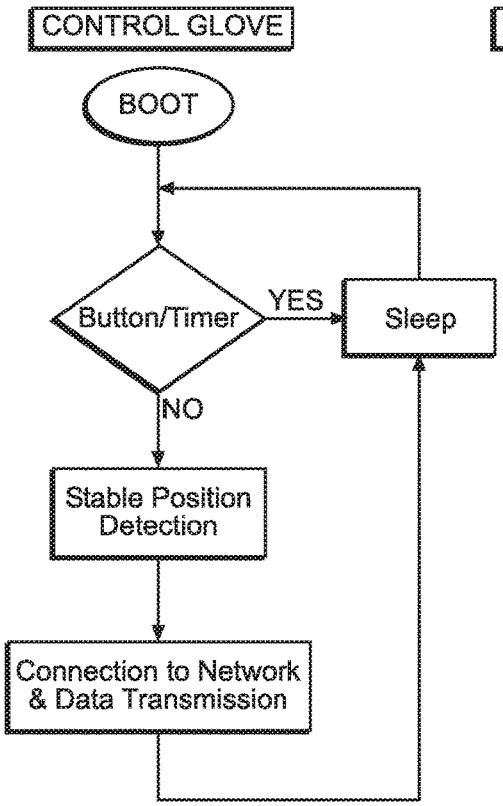
FIG. 12A is a chart showing a working principle of the data-glove of the present invention.
Figure 12B:
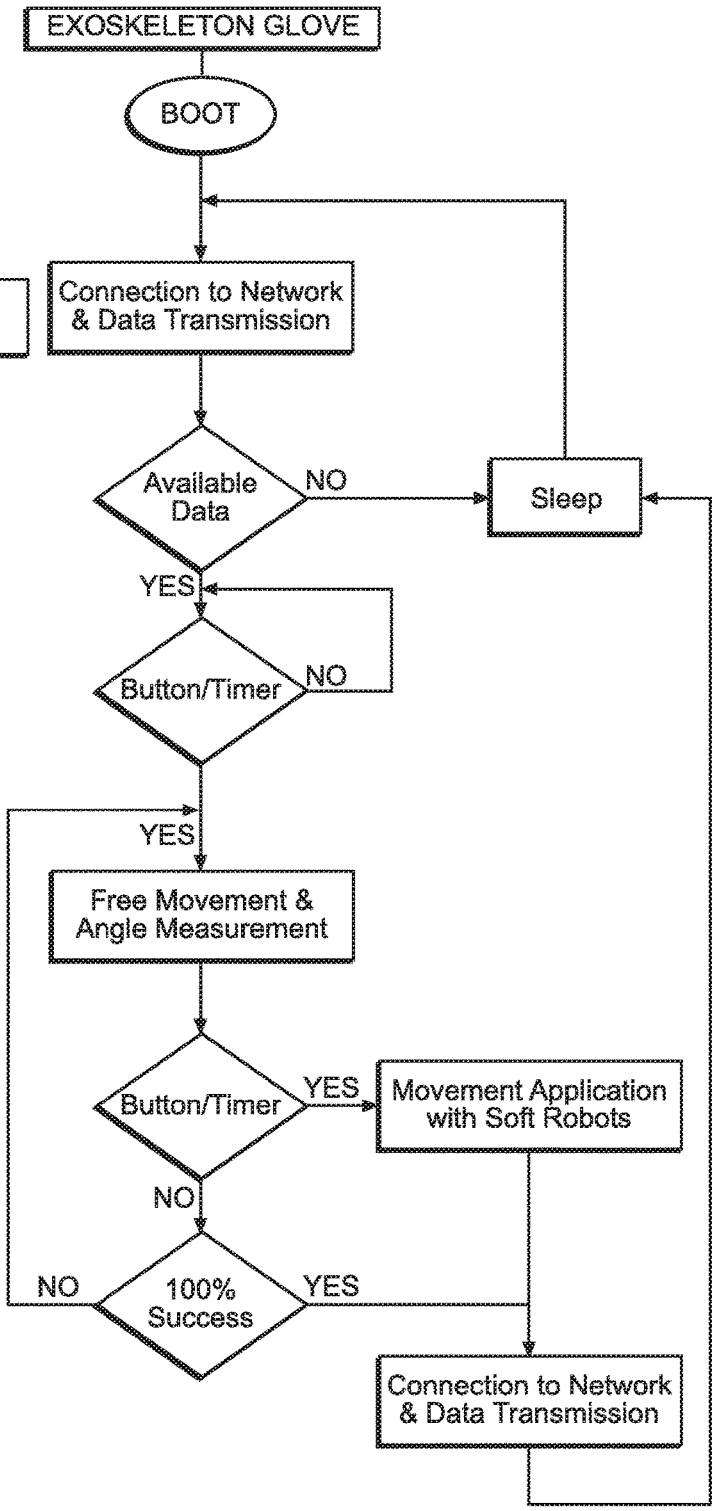
FIG. 12B is a chart showing a working principle of the exoskeleton of the present invention.

The basic working principal of the control glove and the exoskeleton glove are illustrated in FIGS. 12A and 12B. FIG. 12A shows steps of the control glove during mirrored operation with the exoskeleton glove. FIG. 12B shows steps of the exoskeleton glove during mirrored operation with the control glove. Together, FIGS. 12A and 12B show the simultaneous steps of the dual glove system in operation. Starting with the control glove and FIG. 12A, the control glove is turned on at the BOOT stage. Upon booting, the control glove is put to sleep or made to go inactive with a button or timer. If not, the control glove detects a stable position of each finger and thumb of the healthy limb as data. This data is then transmitted upon connection to a network and/or the microprocessor of the exoskeleton glove.

During operation of the dual glove system, the exoskeleton glove in FIG. 12B is simultaneously booted up and connects to the network or microprocessor of the control glove. If data regarding the stable position of each finger and thumb of the health limb is available from the control glove, the exoskeleton will proceed to free movement and angle measurement of each finger and thumb of the damaged limb if a button or timer is initiated. If no data is available, the exoskeleton glove will enter a sleep mode. During free movement and angle measurement, initiation or expiration of a timer leads to application of the exoskeleton to move each finger and thumb on the damaged limb to mirror the position of the healthy limb. Data is then sent via the connection to the network and/or control glove and the exoskeleton is put to sleep until further positional data is received from the control glove. If a button or timer is not engaged, and the exoskeleton glove is in an unrestricted, free-use mode, the patient may freely move while angle measurements are taken on a loop until the damaged limb matches the healthy limb at 100%, at which point the data is transmitted to the network and/or control glove and the exoskeleton glove is put to sleep until further data is received.

An algorithm is used across embodiments of the dual glove system that controls the exoskeleton of the exoskeleton glove. The algorithm converts the resistance value at a position value recorded by the flex sensors of the control system. The abstraction and/or comparative method used between the exoskeleton glove and the control glove generates the data of the patient's involvement in the execution and completion of the movement mentioned above. Also, in the exoskeleton there are five sensors, flex or otherwise, which record data on the degree of malfunction, or deficiency in movement, of the fingers. This data can be viewed by a therapist on a screen having data transmitted to it in real time from the dual glove system directly or indirectly. It's a direct system of automatic evaluation of the degree of dysfunction and/or spasticity that the patient has and patient involvement in the treatment.

With this system, the therapist has a total and percentage figure of the each patient's dysfunction and may he or she may suggest specific exercises in order to focus on improving specific fingers that are weaker. First, the patient performs the desired movement with the healthy hand, which generates the data of the fingers movement to the exoskeleton. Then, with the data collected from the healthy hand, the patient tries to perform the same movement as the hemiplegic hand. During this effort, the sensors measure the degree of patient involvement in the completion of the movement. So, when the system detects that the patient is unable to complete the movement, the exoskeleton directly assists fingers in execution of the movement until the tilting of the fingers coincides with the position of the normal, healthy limb. The sensors that exist in the fingers of the exoskeleton make the system possible to adapt to the case of hemiplegia, allowing the patients to initiate the recovery procedure immediately after the episode that causes this disorder, focusing on the brain's training. This has the effect of adapting the system to each case of dysfunction thus covering the whole range of rehabilitation, in all stages of stroke recovery. In particular, the assistance offered by the exoskeleton is differentiated in each case. The better the mobility of the patient, the assistance provided by the exoskeleton gradually decreases.

The software running at any of the source and target devices, physical, virtual and cloud servers may be implemented in any computing language, or in an abstract language (e.g. a metadata-based description which is then interpreted by a software or hardware component). The software running in the above mentioned hardware, effectively transforms a general-purpose or special-purpose hardware, or computing device, or system into one that specifically implements the present innovative solution.

The above exemplary embodiments are intended for use either as a standalone solution or as part of other methods, processes and systems.

The above exemplary embodiment descriptions are simplified and do not include hardware and software elements that are used in the embodiments but are not part of the current solution, are not needed for the understanding of the embodiments, and are obvious to any user of ordinary skill in related art. Furthermore, variations of the described method, system architecture, and software architecture are possible, where, for instance, method steps, and hardware and software elements may be rearranged, omitted, or new added.

Various embodiments of the invention are described. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventors that the words and phrases in the specification and claims be given the ordinary and accustomed meanings to those of ordinary skill in the applicable art(s).

The foregoing description of a preferred embodiment of the invention known to the applicant at this time of filing the application has been presented and is intended for the purposes of illustration and description. It is not intended to be exhaustive or limit the invention to the precise form disclosed and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated. Therefore, it is intended that the invention not be limited to the particular embodiments disclosed for carrying out this invention, but that the invention will include all embodiments falling within the scope of the appended claims.

In one or more exemplary embodiments, the functions described may be implemented in hardware, software, firmware, or any combination thereof. If implemented in software, the functions may be stored on or transmitted over as one or more instructions or code on a computer readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CDROM or other optical disk storage, magnetic disk storage or other magnetic storage devices, or any other medium that can be used to carry or store desired program code in the form of instructions or data structures and that can be accessed by a computer or any other device or apparatus operating as a computer. Also, any connection is properly termed a computer-readable medium. For example, if the software is transmitted from website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method of rehabilitation using position feedback of an impaired extremity to complete the positional movement associated with an exercise using an exoskeleton robotic arm employing both active and passive motion, the method comprising:

providing the exoskeleton robotic arm, an electronic controller and at least one sensor;

determining a position of a healthy extremity by the at least one sensor;

determining a position of the impaired extremity by the at least one sensor;

directing a patient to attempt to mirror the position of the impaired extremity with the position of the healthy extremity;

calculating with the electronic controller the amount of relative positional motion of one or more locations on the impaired extremity needed to cause the exoskeleton robotic arm to complete the positional movement necessary to mirror the position of the impaired extremity with the position of the healthy extremity after waiting a period of time sufficient to allow a patient to passively partially complete the exercise on their own; and causing with the electronic controller the exoskeleton to provide active assisted motion to help the patient to complete the positional movement.

2. The method of claim 1, wherein the position of a healthy extremity is determined using a control glove having a plurality of sensors, wherein a sensor of the plurality of sensors extends along the length of each digit of the control glove and corresponding to each digit of the healthy extremity, and a control glove control system electronically connected to the at least one actuator and the plurality of sensors.

3. The method of claim 2, wherein the plurality of sensors on the control glove collect and transmit data regarding position of each digit on the healthy extremity to an exoskeleton glove.

4. The method of claim 1, wherein the position of the impaired extremity is determined using an exoskeleton glove having an exoskeleton configured to extend at least along the length of each digit of the impaired extremity, at least one actuator mechanically connected to the exoskeleton and capable of at least flexing a portion of the exoskeleton extending along the length of each digit, a plurality of sensors, wherein a sensor of the plurality of sensors extends along the length of each digit of the exoskeleton glove and corresponding to each digit of the impaired extremity, and an exoskeleton glove control system electronically connected to the at least one actuator and the plurality of sensors.

5. The method of claim 4, wherein the plurality of sensors on the exoskeleton glove collect and transmit data regarding position of each digit on the impaired extremity.

6. A dual glove system for rehabilitating a damaged hand after a stroke, comprising:

an exoskeleton glove having an exoskeleton configured to extend at least along the length of each digit of a damaged hand, at least one actuator mechanically connected to the exoskeleton and capable of at least flexing a portion of the exoskeleton extending along the length of each digit, a plurality of sensors, wherein a sensor of the plurality of sensors extends along the length of each digit of the exoskeleton glove and corresponding to each digit of the damaged hand, and an exoskeleton glove control system electronically connected to the at least one actuator and the plurality of sensors;

a control glove having a plurality of sensors, wherein a sensor of the plurality of sensors extends along the length of each digit of the control glove and corresponding to each digit of healthy hand, and a control glove control system electronically connected to the at least one actuator and the plurality of sensors;

wherein the plurality of sensors on the control glove collect and transmit data regarding position of each digit on the healthy hand via the control glove control system to the exoskeleton glove control system, and the exoskeleton glove control system instructs the at least on actuator to move the exoskeleton causing the damaged hand to mirror the position of the healthy hand regardless of a position of each digit of the damaged hand upon the exoskeleton glove control system receiving the data gathered by the plurality of sensors on the control glove; and an algorithm employed on the exoskeleton glove control system which converts a resistance value at a position value recorded by the plurality of sensors of the exoskeleton glove to generate percentage data of the patient's involvement in the execution and completion of a movement.

7. The system of claim 6, wherein each sensor of the plurality of sensors on the exoskeleton glove and the exoskeleton extending along a length of each digit of the damaged hand are housed within a flexible sensor extending along the length of each digit of the damaged hand.

8. The system of claim 6, wherein each of the at least one actuator is either pneumatic, hydraulic, or motorized.

9. A method of rehabilitation using position feedback of an impaired extremity to complete the positional movement associated with an exercise using a dual glove system having an exoskeleton glove employing both active and passive motion, the method comprising:

providing the dual glove system of claim 6;

determining a position of a healthy extremity;

determining a position of the impaired extremity;

directing a patient to attempt to mirror the position of the impaired extremity with the position of the healthy extremity;

calculating the amount of relative positional motion of one or more locations on the impaired extremity needed to cause the exoskeleton glove to complete the positional movement necessary to mirror the position of the impaired extremity with the position of the healthy extremity after waiting a period of time sufficient to allow a patient to passively partially complete the exercise on their own; and causing the exoskeleton glove to provide active assisted motion to help the patient to complete the positional movement.

10. The system of claim 6, wherein the exoskeleton glove is configured to be secured around a damaged foot, and wherein the control glove is configured to be secured around a healthy foot.

* * * * *